United States Patent [19]

Erath et al.

[11] 3,952,349

[45] Apr. 27, 1976

[54] VARIABLE BUOYANCY DEVICE

[75] Inventors: Robert L. Erath, Seaford; Mathias A. Speidel, St. James; Edward J. Kennelly, Bayport, all of N.Y.

[73] Assignee: Grumman Aerospace Corporation, Bethpage, N.Y.

[22] Filed: Nov. 18, 1974

[21] Appl. No.: 524,950

[52] U.S. Cl. ..... 9/8 R; 73/170 A; 114/16 E

[51] Int. Cl.[2] ..... B63G 8/14

[58] Field of Search ..... 9/8 R; 114/235 B, 16 R, 114/16 E, 25; 61/69 R, 69 A; 73/170 A, 300; 102/14

[56] References Cited

UNITED STATES PATENTS

| | | | |
|---|---|---|---|
| 1,120,621 | 12/1914 | Lindmark | 102/14 |
| 3,179,962 | 4/1965 | Shear et al. | 102/14 |
| 3,257,672 | 6/1966 | Meyer et al. | 9/8 R |
| 3,436,776 | 4/1969 | Davis | 9/8 R |
| 3,590,635 | 7/1971 | Duing | 73/170 A |
| 3,605,418 | 9/1971 | Levine | 61/69 |

*Primary Examiner*—Trygve M. Blix
*Assistant Examiner*—Charles E. Frankfort
*Attorney, Agent, or Firm*—Morgan, Finnegan, Pine, Foley & Lee

[57] ABSTRACT

A variable buoyancy device for automatically cycling an object between upward and downward limits including a regulator valve, inflatable device, deep dive control system, shallow dive control system, differential pressure valve, and weight compensating mechanism, as desired, all coacting to automatically cycle the variable buoyancy device between upper and lower depth limits corresponding to predetermined sea water pressures.

23 Claims, 4 Drawing Figures

VARIABLE BUOYANCY DEVICE

The present invention relates to variable buoyancy devices, and more specifically to an automatically cycled variable buoyancy device.

It is generally known in the art to provide apparatus to moor an object (instrument package) at a predetermined depth, see Waller et al. U.S. Pat. No. 3,256,583, Stixrud U.S. Pat. No. 3,276,049; and Bayles U.S. Pat. No. 3,471,877. It is also known to provide a variable buoyancy device for suspending or hovering an instrument package at a predetermined depth by making the instrument package neutrally buoyant, see Schear et al. U.S. Pat. No. 3,179,962 and Meyer et al. U.S. Pat. No. 3,257,672. However, any incidental cyclic action is an unwanted by-product of the valve design and it is not adjustable. Further, it is known to provide a buoyancy device in which the buoyancy may be varied in response to signals from a surface vessel, see Clark U.S. Pat. No. 3,256,539.

It is an object of the present invention to provide a variable buoyancy device which is automatically cycled between the two adjustable, preset, depth limits.

It is a further object of the present invention to provide a rugged and compact variable buoyancy device.

It is a still further object of the present invention to provide an automatic variable buoyancy device that can be attached to an oceanographic instrument to automatically cycle the instrument upward and downward on a cable moored in the water.

Other objects, aspects, and advantages of the present invention will be apparent when the detailed description is considered in conjunction with the drawings.

Briefly, the present invention includes a pressurized gas source, regulator means, inflatable means, deep dive control valve means, shallow dive control valve means, differential pressure valve means, and compensating means, as desired, all coacting to automatically cycle the device between upward and downward limits corresponding to predetermined sea water pressures.

The present invention is illustrated in the accompanying drawings, in which.

Figure 1:
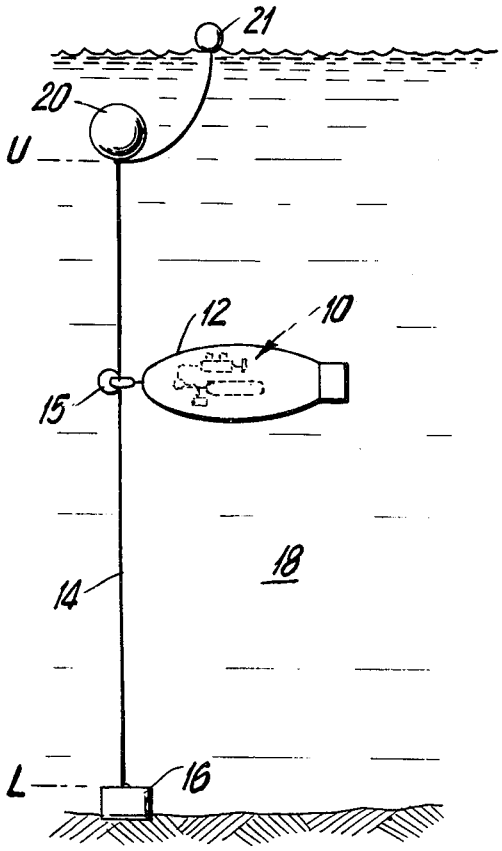
FIG. 1 is a side view in elevation of a container, including the present invention and an instrument package, movably mounted on a cable moored in water.

Referring to FIG. 1, the variable buoyancy device 10 is housed in a perforated container 12 which also includes an instrument package (not shown). The container 12 is movably mounted on a cable 14, e.g., via a pulley 15. The cable 14 is held fixed at its bottom end by a mooring 16 which rests at the bottom of a body of water 18, e.g., the sea. The cable 14 is attached at its upper end to a subsurface float 20 which coacts with the mooring 16 to maintain the cable 14 in a taut extended condition. A surface buoy 21 is coupled to the subsurface float 20 to indicate the location of the container 12.

Figure 2:
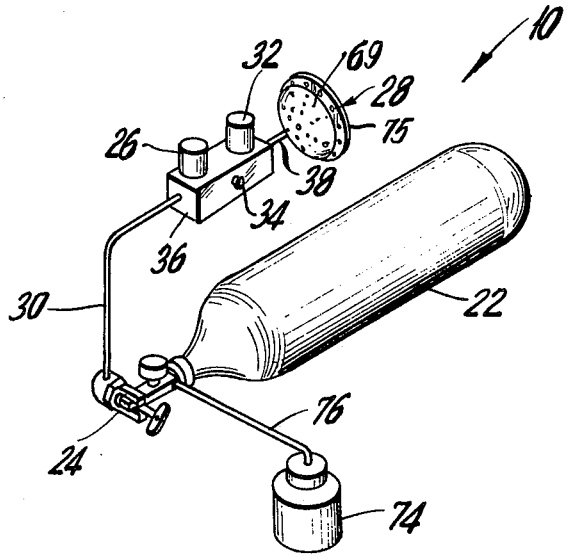
FIG. 2 is a perspective view of the variable buoyancy device of the present invention.

Referring to FIG. 2, the variable buoyancy device 10 includes a source of pressurized gas, e.g., a standard SCUBA tank 22, commercially available from a source such as United States Divers of California. Preferably, a low molecular weight gas is utilized, e.g., helium, to reduce mass loss. The pressure of the gas exiting from the tank 22 is controlled by a regulator valve 24 which is mechanically coupled to the tank 22. A suitable regulator valve is Dacor, Model 200, available from the Dacor Manufacturing Co. of Ill. The regulator valve 24 provides gas to a deep dive or high pressure control valve 26 at a pressure greater than the ambient water pressure and is adjusted to maintain a differential pressure independent of the depth of the container 12, e.g., 0.352–3.16 kg/cm$^2$ above the ambient water pressure. This ensures sufficient, but not excessive, gas pressure to inflate a bladder 28.

The deep dive control valve 26, a shallow dive or low pressure control valve 32, and a differential pressure valve 34 are advantageously contained in a Lexan housing 36. The shallow dive control valve 32 is mechanically coupled to the bladder 28 with a flexible hose 38 and the deep dive control valve 26 is mechanically coupled to the regulator valve 24 with a flexible hose 30.

Figure 3:
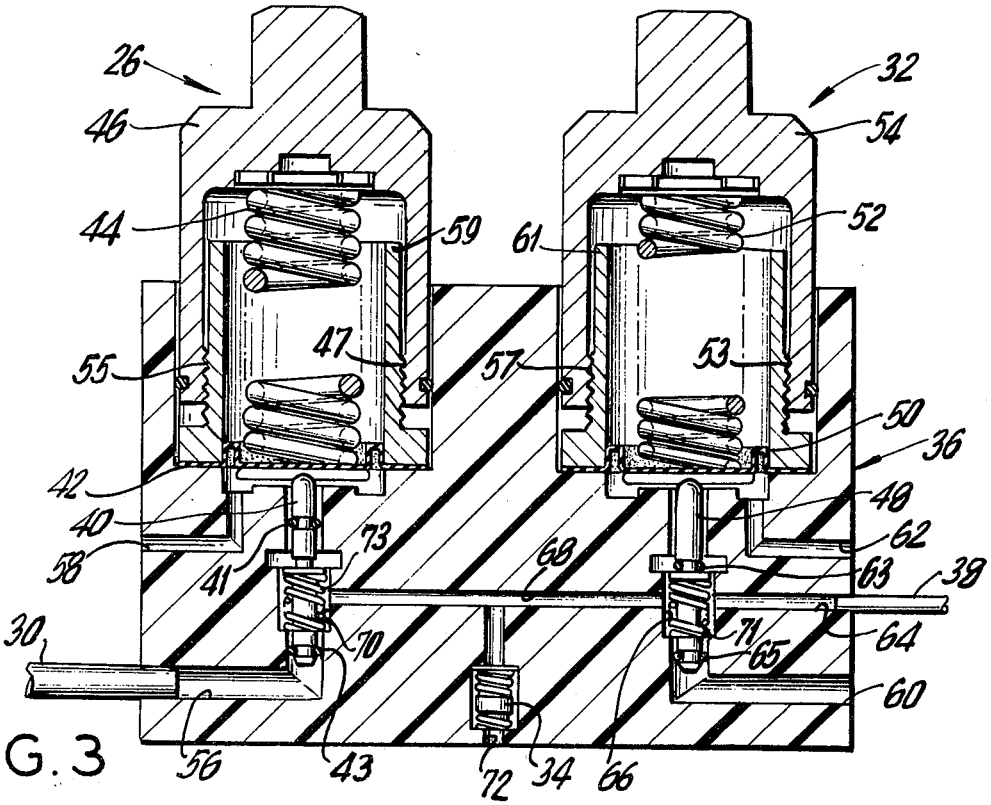
FIG. 3 is a sectional view of one construction for the deep dive and shallow dive control valves and differential pressure valve.

Referring specifically to FIG. 3, the deep dive control valve 26 includes a spool valve 40, a diaphragm 42, a reference spring 44, and a threaded adjusting cap 46. Likewise, the shallow dive control 32 includes a spool valve 48, a diaphragm 50, a reference spring 52, and a threaded adjusting cap 54.

The threaded adjusting caps 46 and 54 have indicators (not shown) to show the number of turns which they have undergone. Threads 47 and 53 on the inner surface of the adjusting caps 46 and 54, respectively, engage mating threads 55 and 57 on the exterior surface of sleeves 59 and 61 enabling the caps 46 and 54 to be adjusted relative thereto. Each valve 26 and 32 is calibrated empirically in any well known manner to obtain a calibration curve of turns versus pressure of depth. This curve may be referred to for an accurate setting of the depth limits, i.e., U and L, see FIG. 1.

A first port 56 provides communication between the exterior of the housing 36 and one end of the spool valve 40 and a second port 58 provides communication between the exterior of the housing 36 and the underside of the diaphragm 42 of the deep dive control valve 26. A third port 60 provides communication between the exterior of the housing 36 and one end of the spool valve 48 and a fourth port 62 provides communication between the exterior of the housing 36 and the underside of the diaphragm 50 of the shallow dive control valve 32. Additionally, a fifth port 64 provides communication between the spool valve seat 66 and the exterior of the housing 36. A channel 68 provides communication between the valve seat 66 and the valve seat 70 of the deep dive control valve 26. A sixth port 72 provides communication between the channel 68, the differential pressure valve 34, and the exterior of the housing 36.

First port 56 is coupled to the flexible hose 30 which is connected to regulator valve 24 of the tank 22. Fifth port 64 is coupled to the flexible hose 38, which is connected to the bladder 28. The remaining ports 58, 60, 62, and 72 are vented to the sea water through fine screen filters (not shown).

The diaphragm 42 is biased on its top or upperside by the reference spring 44 which is loaded by turning the adjusting cap 46 which is in engagement therewith. The reference spring 44 of the deep dive control valve 26 will generally provide a lower depth limit of between about 35 and about 200 meters. However, other springs may be employed as desired to provide a different lower depth range.

The reference spring 44 normally holds the spool valve 40 in its closed position, preventing the gas which enters the first port 56 from entering fifth port 64 and inflating the bladder 28. However, when the sea water pressure exerted on the underside of the diaphragm 42 through second port 58 exceeds the spring force of the loaded reference spring 44, the spool valve 40 is lifted, due to the force of its biasing spring 73, providing communication between first port 56 and fifth port 64 to bladder 28 via valve seat 70, channel 68, and valve opening 66. A sealing ring 41 mounted on the upper portion of the spool valve 40 and a sealing ring 43 mounted on the lower portion of the spool valve 40 normally prevent the passage of air and water through ports 56 and 68, respectively. However, when the spool valve 40 is lifted, sealing ring 43 is moved upwardly allowing the passage of air to the fifth port 64 and to the bladder 28. The bladder 28 is thus inflated and moves container 12 upward along the cable 14. After the container 12 rises a few meters, the spool valve 40 is again closed due to the force of the reference spring 44, i.e., the sealing ring 43 blocks communication between the port 56 and port 64, and the bladder 28 remains inflated.

During the ascent of the container 12, the sea water pressure gradually decreases. The differential pressure valve 34 vents the bladder 28 through port 72 when the differential pressure between the bladder 28 and the sea water exceeds a predetermined value, e.g., 2.60 $kg/cm^2$.

The shallow dive control valve 32 controls the upper limit of movement of the container 12. At the lower depths, the presence of sufficient water pressure at fourth port 62 causes the diaphragm 50 and spool valve 48, due to the force of its biasing spring 71, to move upwardly against the force of the loaded reference spring 52 so that the sealing ring 63 mounted on the upper portion of the spool valve 48 and the sealing ring 65 mounted on the lower portion of the spool valve 48 normally prevent the passage of air through ports 60 or 62. When the sea water pressure at fourth port 62 is reduced, the loaded reference spring 52 moves the diaphragm 50 and spool valve 48 downwardly, opening the spool valve 48 and sealing ring 63, see FIG. 3, allowing gas to escape from the bladder 28 through the fifth port 64 and valve seat 66 to the fourth port 62 and thus into the sea. The third port 60 enables the sea water to equalize the pressure on the spool valve 48. The reference spring 52 of the shallow dive control valve 32 will generally provide an upper depth limit of between about 3 and about 26 meters. However, other springs may be employed, as desired, to provide a different upper depth range.

Advantageously, the bladder 28 may include a neoprene sheet of approximately 24 cm dia, sandwiched between a permeable hemispherical A.B.S. cap 69 and a thick A.B.S. plastic base 75. The displacement volume change which is approximately 600 cc. may be increased or decreased, as desired, by changing the size of the permeable hemispherical cap 69. Upon inflation of the bladder 28, the gas from the tank 22 enters the bladder 28 into the space between the neoprene sheet and the plastic base 75 distending the neoprene sheet for engagement with the inside of the permeable hemispherical cap 69 and displacing the water between the neoprene sheet and the permeable hemispherical cap 69.

Advantageously, the variable buoyancy device 10 may include a compensating means 74. The compensating means 74 is mechanically coupled to the SCUBA tank 22 through a flexible hose 76 and collects sea water to replace the weight of gas lost from the SCUBA tank 22. In the absence of compensating means 74, as gas is expelled from the device 10, there is no compensation for weight loss. Therefore, at some point the container 12 will not descend even though the bladder 28 is deflated. That is, the container becomes neutrally buoyant due to weight loss. Therefore, it may be advantageous to increase the weight of the container 12 automatically by an apparatus such as compensating means 74 to compensate for weight loss.

Figure 4:
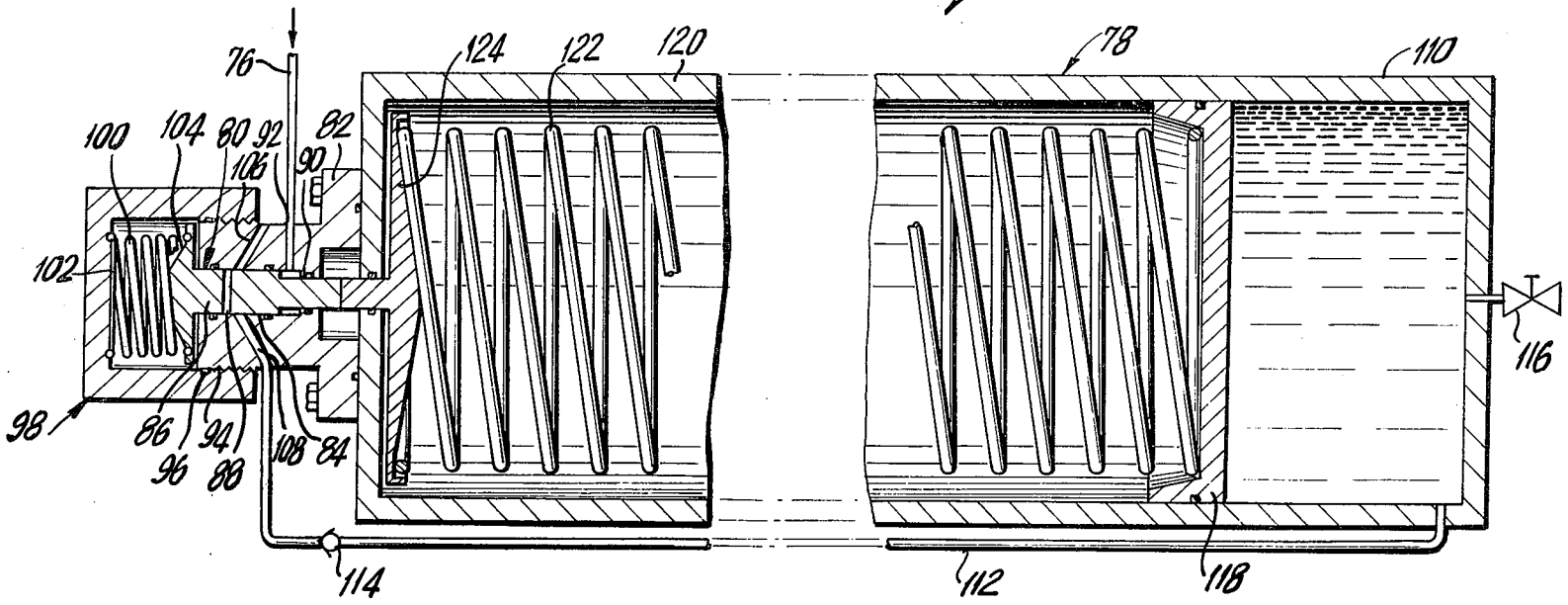
FIG. 4 is a sectional view of one construction for the compensating tank and associated valve.

One form of compensating means 74 is illustrated in FIG. 4. The compensating means 74 includes a compensating tank 78 and a compensating valve 80 connected to the compensating tank 78. The compensating valve 80 is mounted in a valve receiving body 82 which is connected to the compensating tank 78. The valve receiving body 82 includes a central aperture 84 to receive the compensating valve 80 which is in the form of a spool valve. The compensating valve 80 includes a body portion 86 with a transverse channel 88 and a reduced end portion 90 of smaller diameter.

A gas inlet 92 arranged in the valve receiving body 82 provides communication between the reduced end portion 90 and the flexible hose 76 and biases the body portion 86 to a closed position in the presence of gas of sufficient pressure in the flexible hose 76.

The valve receiving body 82 includes threads 94 to receive mating threads 96 on an adjustable end cap 98. A reference spring 100 is biased between the end wall 102 of the adjustable end cap 98 and the top 104 of the body portion 86.

The valve receiving body 82 includes a water inlet 106 and a tank inlet 108. The tank inlet 108 is connected to the remote portion 110 of the compensating tank 78 by a conduit 112. The conduit 112 may advantageously include a check valve 114 and the remote portion 110 may advantageously include a drain valve 116.

The compensating tank 78 includes a piston 118 separating its remote portion 110 from its near portion 120. The spring 122 is biased between the postion 118, at one end, and a force transmitting member 124 at the opposite end. The force transmitting member 124 is mechanically coupled to the reduced end portion 90 of the compensating valve 80.

During operation of the variable buoyancy device 10, the deep dive control valve 26 opens at a predetermined sea water depth (pressure) to provide the downward or lower limit for the automatic cycling of the device 10. The shallow dive control valve 32 opens at a predetermined sea water depth (pressure) to expel gas from the bladder 28 and provide the upward or upper limit for the automatic cycling of the device 10. (Due to the finite response time of the valves 26 and 32, the limits of the upward and downward movement of the device 10 may be slightly greater than the water depths corresponding to the sea water pressures which actuate the valves 26 and 32. However, since the container 12 is normally moving upward or downwardly at a relatively slow rate, the action of the valves 26 and 34 may, for all intents and purposes, be considered as instantaneous).

The desired instrument, e.g., a recorder (not shown) is mounted on the container 12. The container 12 will descend since it has a gravimetric weight greater than the weight of the displaced water (negative buoyancy). At a predetermined depth, as determined by the setting of the reference spring 44, the deep dive control valve 26 opens to supply pressurized gas from the tank 22 to the bladder 28, causing inflation thereof. The gravimetric weight of the container 12 thereby becomes less than the weight of the displaced water and the container 12 begins to ascend (positive buoyancy); the deep dive control valve 26 then closes. During ascent, the differential pressure valve 34 is operative to limit pressure build-up in the bladder 28 by allowing the gas to bleed out, as necessary. This prevents overpressurization and destruction of the bladder 28 due to an increasing differential pressure since the sea water pressure is decreasing during ascent.

When the container ascends to a predetermined depth, as determined by the setting of the reference spring 52, the shallow dive control valve 32 opens and the bladder 28 is deflated. The container 12 then begins to descend due to its negative buoyancy and the shallow dive control valve 32 closes. The container 12 continues to descend until it reaches the predetermined depth corresponding to the sea water pressure which opens the deep dive control valve 26. This action is repeated automatically and cyclically, e.g., for hundreds of cycles.

It is evident that during each cycle, gas is removed from the SCUBA tank 22 and expelled from the container into the sea water. To replace the weight loss of gas during each cycle, and thereby increase the cycle life of the device 10, the compensating means 74 collects the sea water equivalent to the loss of weight in gas. The compensating means 74 senses the pressure remaining in the SCUBA tank 22 and allows sea water to enter the tank 78. The reference spring 100 in response to a drop in pressure in the SCUBA tank 22 moves the compensating valve 80 to the right. The transverse channel 88 aligns with and provides communication between the water inlet 106 and tank inlet 108. Sea water flows into the water inlet 106 and tank inlet 108, and through the conduit 112 into the remote portion 110 of the compensating tank 78. The water pressure in the remote portion 110 eventually moves the piston 118, feedback spring 122, and force transmitting member 124 to the left. The compensating valve 80 which is mechanically coupled to the force transmitting member 124 is also moved to the left interrupting communication between the water inlet 106 and the tank inlet 108. This action is repeated during each cycle to ensure that the variable buoyancy device 10 maintains a constant weight.

When the container 12 is in a stored condition, e.g., on-board ship, the deep dive control valve 26 is in its closed position, preventing loss of gas from the SCUBA tank 22 even though the shallow dive control valve 32 is open. Thus, the device 10 is self-starting and does not have to be activated when mounted on the cable 14. Initially, the container 12 is negatively buoyant and descends toward its lower, preset, depth limit. As it passes its upper, preset, depth limit, the shallow dive control valve 32 closes. When the deep dive control valve 26 opens at the lower depth limit, the bladder 28 is inflated and the container 12 becomes positively buoyant. After the container 12 rises approximately 1 or 2 meters from its lower depth limit, the deep dive control valve 26 closes and the bladder 28 remains inflated until the shallow dive control valve 32 opens at the upper depth limit. The container 12 continues to cycle automatically until all of the gas in the SCUBA tank is consumed or until the container 12 is retrieved.

It should be understood by those skilled in the art that various modifications may be made in the present invention without departing from the spirit and scope thereof, as described in the description and defined in the appended claims.

What is claimed is:

1. A variable buoyancy device for automatically cycling an instrument between upward and downward limits in water, comprising:

a pressurized gas source;

a regulator valve coupled to said pressurized gas source for reducing the exiting gas pressure to a predetermined level which is greater than the ambient water pressure;

inflatable means coupled to said regulator valve for inflation in response to gas exiting from said pressurized gas source;

first and second control valves interposed between said regulator valve and said inflatable means, said first control valve having an adjustably presettable reference means for establishing a predetermined lower depth limit for admitting gas to said inflatable means when said first control valve descends to the predetermined lower depth limit, said second control valve having an adjustably presettable reference means for establishing an upper depth limit for expelling gas from said inflatable means when said second control valve ascends to the predetermined upper depth limit, said first and second control valves coacting to provide continuous automatic cycling of the variable buoyancy device between the predetermined upper and lower depth limits.

2. The variable buoyancy device as claimed in claim 1, including:

a differential pressure valve for maintaining a preset pressure differential between said inflatable means and the ambient water pressure during ascent.

3. The variable buoyancy device as claimed in claim 2, wherein:

said differential pressure valve limits the pressure build-up in said inflatable means during ascent to approximately 2.60 $kg/cm^2$ above the ambient water pressure.

4. The variable buoyancy device as claimed in claim 2, including:

a first port providing communication between said first control valve and the water into which the variable buoyancy device is submerged;

a second port providing communication between said regulator valve and said first control valve;

third and fourth ports providing communication between said second control valve and the water into which the variable buoyancy device is submerged;

a fifth port providing communication between said first control valve and said second control valve;

a sixth port providing communication between said second control valve and said inflatable means; and a seventh port providing communication between said fifth port and the water into which said variable buoyancy device is submerged through said differential pressure valve.

5. The variable buoyancy device as claimed in claim 4, wherein:

said differential pressure valve limits the pressure build-up in said inflatable means during ascent to approximately 2.60 kg/cm² above the ambient water pressure.

6. The variable buoyancy device as claimed in claim 4, including:

compensating means having a water collecting tank and a compensating valve for collecting water to make up for the loss of weight resulting from the exiting of gas from said pressurized gas source.

7. The variable buoyancy device as claimed in claim 1, including:

compensating means having a water collecting tank and a compensating valve for collecting water to make up for the loss of weight resulting from the exiting of gas from said pressurized gas source.

8. The variable buoyancy device as claimed in claim 1, wherein:

said inflatable means includes a bladder having a cap for controlling the amount of distension of said bladder.

9. The variable buoyancy device as claimed in claim 1, wherein:

said first control valve includes a first spool valve and a first reference spring, said second control valve includes a second spool valve and a second reference spring, said spool valves being normally held in position by the force of said reference springs.

10. The variable buoyancy device as claimed in claim 9, including:

first and second diaphragms disposed between said first and second spool valves and reference springs, respectively, for engagement thereby;

a first port providing communication between the surface of said first diaphragm engaged by said first spool valve and the water into which the variable buoyancy device is submerged;

a second port providing communication between said regulator valve and said first spool valve;

a third port providing communication between the surface of said second diaphragm engaged by said second spool valve and the water into which said variable buoyancy device is submerged;

a fourth port providing communication between the water into which said variable buoyancy device is submerged and said second spool valve;

a fifth port providing communication between said first spool valve and said second spool valve; and a sixth port providing communication between said second control valve and said inflatable means.

11. The variable buoyancy device as claimed in claim 10, including:

compensating means having a water collecting tank and a compensating valve for collecting water to make up for the loss of weight resulting from the exiting of gas from said pressurized gas source.

12. The variable buoyancy device as claimed in claim 1, wherein:

said adjustably presettable reference means include reference springs and adjusting caps for loading said reference springs.

13. The variable buoyancy device as claimed in claim 1, wherein:

said pressurized gas source is a SCUBA tank including a gas having a low molecular weight.

14. The variable buoyancy device as claimed in claim 1, including:

a first port providing communication between said first control valve and the water into which the variable buoyancy device is submerged;

a second port providing communication between said regulator valve and said first control valve;

third and fourth ports providing communication between said second control valve and the water into which the variable buoyancy device is submerged;

a fifth port providing communication between said first control valve and said second control valve; and a sixth port providing communication between said second control valve and said inflatable means.

15. The variable buoyancy device as claimed in claim 14, including:

compensating means having a water collecting tank and a compensating valve for collecting water to make up for the loss of weight resulting from the exiting of gas from said pressurized gas source.

16. A variable buoyancy device for automatically cycling an instrument between upward and downward limits on a cable moored in water, comprising:

a SCUBA tank including a pressurized gas of low molecular weight;

a regulator valve coupled to said SCUBA tank to reduce the output gas pressure to a predetermined level which is greater than the ambient water pressure;

a bladder mechanically coupled to said regulator valve for inflation in response to gas exiting from said SCUBA tank;

an adjustably presettable deep dive control valve coupling said regulator valve to said bladder to provide inflation of said bladder and positive buoyancy to the device when said deep dive control valve descends to a predetermined lower depth limit; and an adjustably presettable shallow dive control valve coupled to said bladder to provide deflation of said bladder and negative buoyancy to the device when said shallow dive control valve ascends to a predetermined upper depth limit, said adjustably presettable deep and shallow dive control valves coacting to provide continuous automatic cycling of the variable buoyancy device between the predetermined upper and lower depth limits.

17. The variable buoyancy device as claimed in claim 16, including:

compensating means for collecting water to make up for the loss of weight resulting from the gas exiting from said SCUBA tank.

18. The variable buoyancy device as claimed in claim 9, including:

a differential pressure valve for maintaining a preset pressure differential between said bladder and the ambient water pressure during ascent.

19. The variable buoyancy device as claimed in claim 18, wherein:

said differential pressure valve limits the pressure build up in said bladder during ascent to approximately 2.60 kg/cm² above the ambient water pressure.

20. The variable buoyancy device as claimed in claim 18, including:

a first port providing communication between said deep dive control valve and the water into which the variable buoyancy device is submerged;

a second port providing communication between said regulator valve and said deep dive control valve;

third and fourth ports providing communication between said shallow dive control valve and the water into which the variable buoyancy device is submerged;

a fifth port providing communication between said deep dive control valve and said shallow dive control valve;

a sixth port providing communication between said shallow dive control valve and said bladder; and a seventh port providing communication between said fifth port and the water into which the variable buoyancy device is submerged through said differential pressure valve.

21. The variable buoyancy device as claimed in claim 20, wherein:

said differential pressure valve limits the pressure build-up in said bladder during ascent to approximately 2.60 kg/cm$^2$ above the ambient water pressure.

22. The variable buoyancy device as claimed in claim 16, including:

a first port providing communication between said deep dive control valve and the water into which the variable buoyancy device is submerged;

a second port providing communication between said regulator valve and said deep dive control valve;

third and fourth ports providing communication between said shallow dive control valve and the water into which the variable buoyancy device is submerged;

a fifth port providing communication between said deep dive control valve and said shallow dive control valve; and a sixth port providing communication between said shallow dive control valve and said bladder.

23. The variable buoyancy device as claimed in claim 22, including:

compensating means having a water collecting tank and a compensating valve for collecting water to make up for the loss of weight resulting from the exiting of gas from said SCUBA tank.

* * * * *

UNITED STATES PATENT AND TRADEMARK OFFICE

CERTIFICATE OF CORRECTION

PATENT NO. : 3,952,349

DATED : April 27, 1976

INVENTOR(S) : Robert L. Erath, Mathias A. Speidel and Edward J. Kennelly

It is certified that error appears in the above-identified patent and that said Letters Patent are hereby corrected as shown below:

Column 8, Line 57: "9" should be --16--.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*